US007634864B2

(12) United States Patent
Segan

(10) Patent No.: US 7,634,864 B2
(45) Date of Patent: Dec. 22, 2009

(54) USER INTERACTIVE GREETING CARD

(75) Inventor: Marc Howard Segan, New York, NY (US)

(73) Assignee: Segan LLC, Mt. Kisco, NY (US)

( * ) Notice: Subject to any disclaimer, the term of this patent is extended or adjusted under 35 U.S.C. 154(b) by 0 days.

(21) Appl. No.: 11/800,190

(22) Filed: May 4, 2007

(65) Prior Publication Data

US 2007/0256337 A1 Nov. 8, 2007

Related U.S. Application Data

(60) Provisional application No. 60/797,722, filed on May 4, 2006.

(51) Int. Cl.
*G09F 1/00* (2006.01)

(52) U.S. Cl. ..... 40/124.03; 40/124.08; 40/421; 40/455; 40/464; 446/151

(58) Field of Classification Search ..... 40/124.03, 40/124.06, 124.08, 421, 455, 464, 486; 446/147, 446/148, 151, 310
See application file for complete search history.

(56) References Cited

U.S. PATENT DOCUMENTS 1,490,295 A * 4/1924 Stephens ..... 434/178
2,705,387 A * 4/1955 Handler et al. ..... 446/151
2,742,287 A * 4/1956 Barker ..... 446/150
3,471,965 A * 10/1969 Glass et al. ..... 446/302
3,580,585 A * 5/1971 Stastny et al. ..... 369/63
3,726,032 A * 4/1973 Atkins ..... 40/473
3,928,928 A * 12/1975 Kalust ..... 40/455
4,102,067 A * 7/1978 Tarrant ..... 40/455
4,791,741 A * 12/1988 Kondo ..... 704/272
5,055,084 A * 10/1991 Jokic ..... 446/486
5,063,698 A * 11/1991 Johnson et al. ..... 40/124.03
5,681,199 A * 10/1997 Morris ..... 446/73
6,523,285 B1 * 2/2003 Gilson et al. ..... 40/124.03

* cited by examiner

*Primary Examiner*—Lesley D. Morris
*Assistant Examiner*—Christopher E Veraa
(74) *Attorney, Agent, or Firm*—Cohen Pontani Lieberman & Pavane LLP

(57) ABSTRACT

A greeting card having a first card panel, a door connected to the first card panel and movable between a closed position where the door substantially covers a section of the first card panel and an open position where the door uncovers the section of the first card panel. A trigger is provided which is movable between a first position wherein the door is prevented from moving, and a second position wherein the door is allowed to move between the closed and open positions. A member which is movable by a user controls operation of the trigger to move the trigger to the second position to allow the door to move to the open position.

26 Claims, 5 Drawing Sheets

USER INTERACTIVE GREETING CARD

CROSS-REFERENCE TO RELATED APPLICATION

This application claims the benefit of U.S. Provisional Application No. 60/797,722, filed on May 4, 2006.

BACKGROUND OF THE INVENTION

1. Field of the Invention

The present invention relates to a greeting card. More specifically, the present invention relates to a musical greeting card in which a recipient/user's manual input is used to control movement of a mechanical element of the card to create an anticipated visually-pleasing effect to the user.

2. Description of the Related Art

Paper greeting cards have existed for many years. Somewhat more recently, such cards have incorporated music to increase the entertainment value of such cards because music tends to enhance the emotional impact of such greeting cards, especially when the music is familiar to the recipients/users. Usually, a musical greeting card looks just like a conventional non-musical greeting card, except that it includes a switch and a miniature integrated circuit (IC) having a microprocessor, memory, speaker, and battery. Both the switch and the miniature IC are embedded in the greeting card so that they are not visible to a recipient/user. Opening the greeting card will automatically turn on or close the switch so that the IC will play pre-stored music at a pre-determined, fixed speed. Closing the greeting card will automatically open the switch and stop the play of the music.

Compared with a conventional non-musical greeting card, a musical greeting card delivers at least two unique and delightful surprises to its recipient/user: first, the interactive surprise of the opening the greeting card and hearing the music, and, second, the meaning or sentimental value of the particular tune and/or music to the recipient of the card.

Other than opening or closing such a greeting card, a recipient/user has no other means to control when or how fast the music will be played and the greeting card offers no other interactive visual surprise to the recipient/user.

SUMMARY OF THE INVENTION

Therefore, one object of the invention is to provide a greeting card in which a recipient/user can control when a visual element is deployed, thus providing an anticipatory entertainment feature to the user.

Another object of the invention is to provide a greeting card which offers user interaction to control the speed of a sound or of music that is played by the card.

Yet another object of the invention is to provide a greeting card with a dynamic visual element, in which a user's manual input activates the visual element which is coordinated with an audio signal that is played by the card.

A still further object of the invention is to provide for a jack-in-the-box type greeting card which provides a crank handle for use by a recipient of the card and such that an activation of a visual element and, optionally, playback of an audio signal, is controlled by the speed at which the crank handle is turned by the recipient.

To meet these and other needs, a greeting card is disclosed which includes a first card panel, a door connected to the first card panel and movable between a closed position where the door overlays or covers a section of the first card panel and an open position where the door does not cover or overlay the section of the first card panel, a trigger movable between a first position and a second position for selectively actuating the door to allow the door to move between the closed position and the open position, and a user-manipulatable member or actuator which, in response to user manipulation, causes the trigger to move from the first position to the second position to allow the door to open.

In one embodiment, a deployable visual member is provided between the section of the first card panel and the door. The visual member is controlled by an urging member for moving the deployable visual element between an undeployed position and a deployed position, the deployed visual member being in the undeployed position when the door is in the closed position and being in the deployed position when the door is in the open position.

In still another embodiment, an audio source operable to play an audio signal is controlled by the user-manipulatable member such that the speed of manipulation will control the speed of playback of the audio signal.

In yet another embodiment, activation of the trigger is synchronized to coincide with playback of the audio signal.

These and other features and advantages of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the drawings, wherein the like reference numerals depict similar elements throughout the several views.

DETAILED DESCRIPTION OF THE PRESENTLY PREFERRED EMBODIMENT

Figure 1:
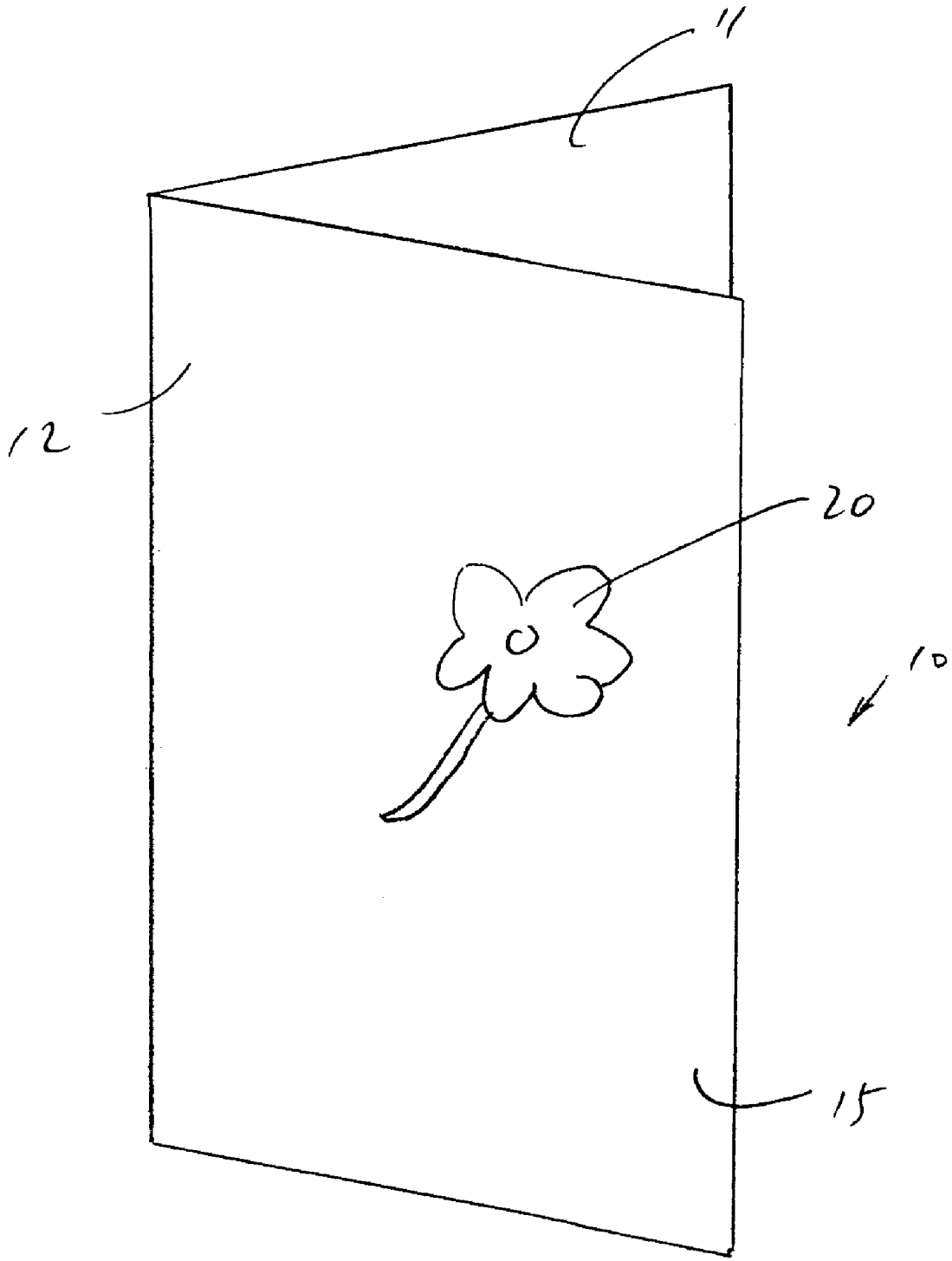
FIG. 1 is a perspective view of a greeting card in accordance with one embodiment of the invention in a partially open position.
Figure 2:
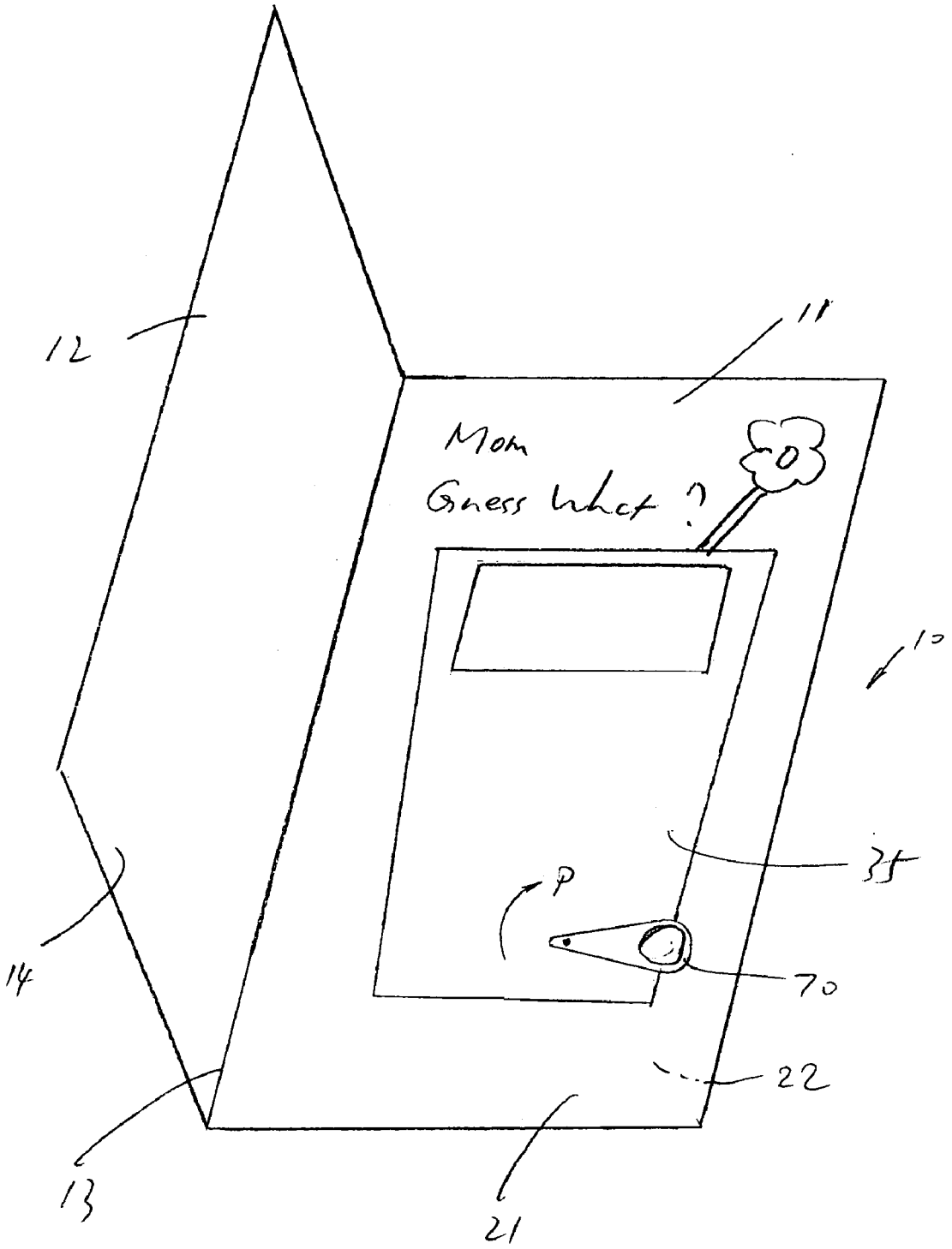
FIG. 2 is another perspective view of the greeting card of FIG. 1 in a substantially open position in which a visual element is in an undeployed position.
Figure 3:
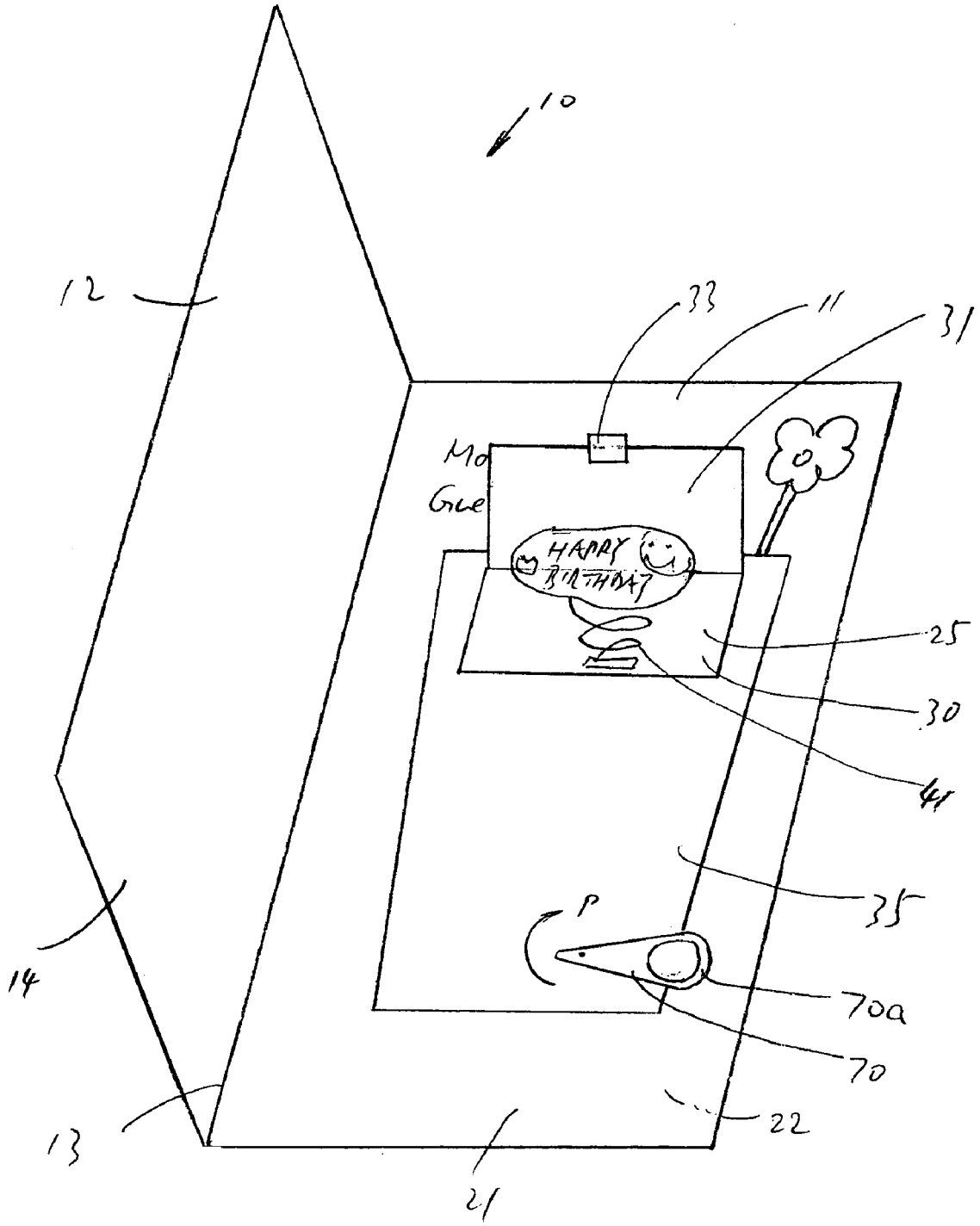
FIG. 3 is another perspective view of the greeting card in the substantially open position in which the visual element is in a deployed position.

A greeting card in accordance with one embodiment of the present invention is generally designated by reference numeral 10 in FIGS. 1-3. The greeting card 10 includes a substantially rectangular-shaped first or back card panel 11 and a substantially rectangular-shaped second or cover panel 12. The cover panel 12 is hingedly connected to the back card panel 11 along a fold line 13. Preferably, the back and cover panels 11, 12 are integrally formed from a blank used for traditional paper greeting cards, as is known by those of skill in the art. The back and cover panels 11, 12 have substantially the same overall shape and size, but they can have different overall shapes and sizes as is presently found among paper greeting cards.

The cover panel 12 has an interior surface 14 which faces a front face of the back card panel 11 when the greeting card 10 is closed. Cover panel 12 also has an opposite, exterior surface 15 which typically contains a greeting message with an optional design such as "Happy Birthday" with a flower design 20.

Figure 6:
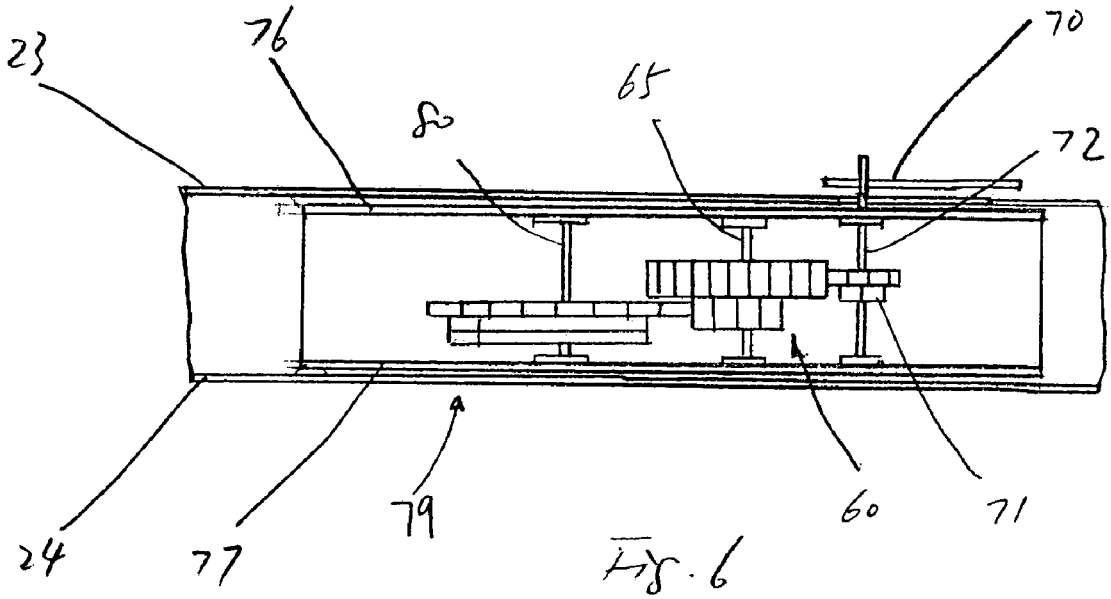
FIG. 6 is an enlarged cross section view of the actuator of FIG. 5.

The back card panel 11 has an interior surface 21 which faces the interior surface 14 of the cover panel 12 when the greeting card 10 is closed, and an opposite, exterior surface 22. Moreover, as shown in FIG. 6, the back card panel 11 preferably has an upper layer 23 which bears the interior surface 21, and a lower layer 24 which bears the exterior surface 22. The upper layer 23 and lower layer 24 form a pocket for containing a mechanical actuator device which, optionally, also produces a playback of a pre-stored sound, as explained more-fully below. As illustrated in FIG. 3, the upper layer 23 has an opening or window 25, through which a section 30 of the lower layer 24 is exposed.

A door 31 is connected to the upper layer 23 so that it is movable between a closed position where the door 31 substantially covers the section 30 (see FIG. 3) and an open position where the door 31 no longer covers section 30. As used herein, "cover" means that the door overlays or otherwise prevents direct viewing of the section 30 by a user when the door is closed, and allows direct viewing of the section 30 when the door is opened. Thus, the door can be made of a clear or colored transparent or semi-transparent material to allow a user to view the section 30 through the closed door, or the door can be made of an opaque material wherein a user cannot see section 30 unless the door is open. To facilitate the movement of the door 31 from its closed position to its open position, an urging member 34 may be provided. In one embodiment the urging member can be a helical tension spring, or any other biasing member 34 which urges, loads or biases the door 31 toward the open position. The door 31 can be integrally formed with the upper layer 23. For example, in the case of a rectangular door 31, three of the four sides can be detached from the upper layer 23, leaving the remaining side as a fold line which remains connected to the upper layer 23. Still other door shapes (triangle, oval, etc.) can be used, as will be readily appreciated by those of ordinary skill in the art.

As shown in FIGS. 2 and 3, the interior surface 21 of the back card panel 11 preferably has a graphic design 35 which extends along the front face of the door 31 so that when the door is closed, a user of the card can view the door design together with the graphic design 35. A graphic design can also be included on section 30 such that when the door 31 is moved to the open position, the graphic design on section 30 will be revealed to the user. Moreover, a graphic design can be included on the back face of the door 31 which will be visible to the user when the door is in the open position. The design on the back of the door can also complement, or otherwise be related to, the design on the section 30 in order to enhance the visual effect of the card.

Figures 4, 5:
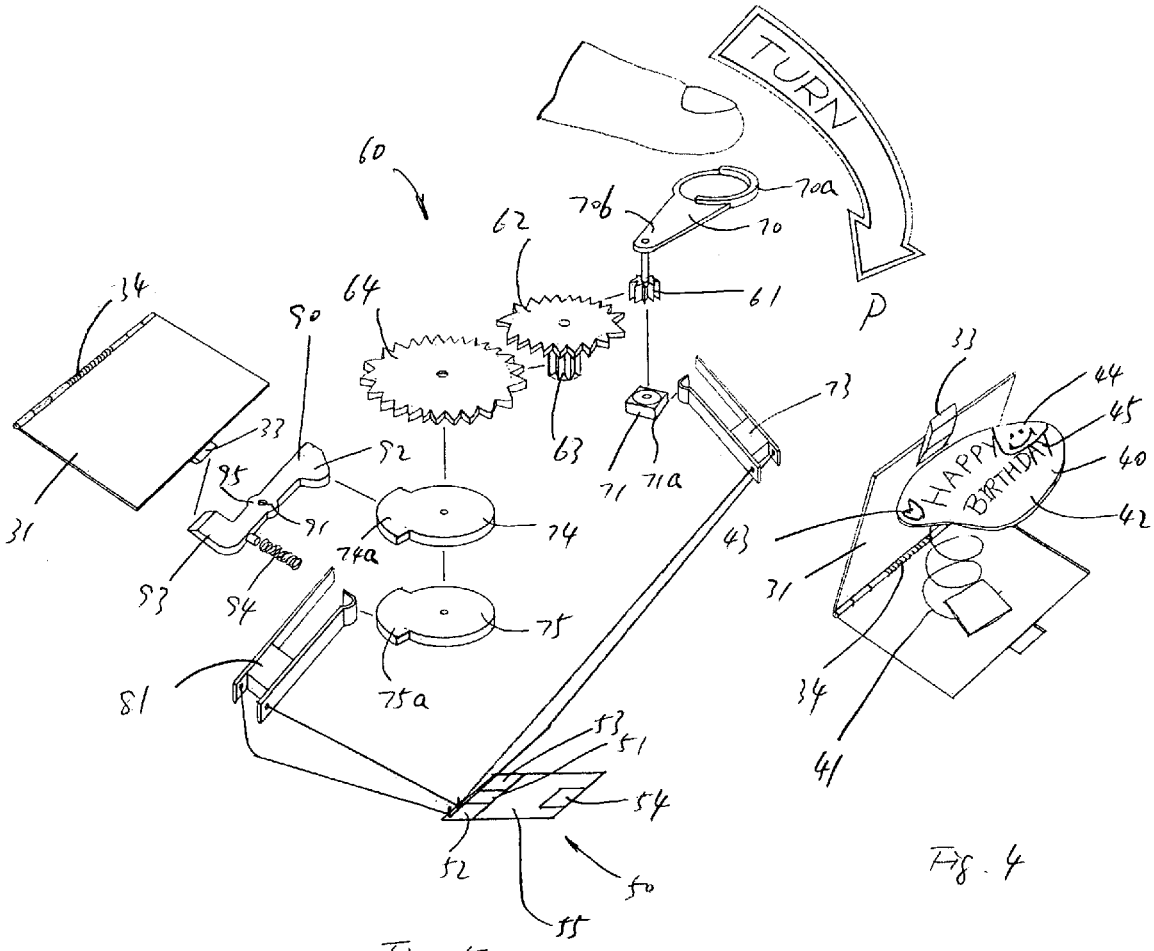
FIG. 4 is perspective view of a greeting card showing a door in an open position and the visual element in the deployed position.
FIG. 5 is an enlarged, partially exploded view of an actuator of the greeting card for deploying the visual element.

In one embodiment, the door 31 also covers and reveals—depending on the position of the door—a deployable visual member or element 40, as explained more fully with reference to FIGS. 3 and 4. The deployable visual member 40, such as a pop-up element, is disposed between the door 31 and the section 30 and can be any shape or configuration. A resilient tether such as an urging member 41 has one end attached to the section 30 and the other end attached to the visual member 40. In one embodiment, the urging member 41 comprises a coil or leaf spring made of metal, plastic or any other resilient material. The spring 41 urges, loads or biases the visual element 40 to move from a first or undeployed position (see FIG. 2) to a second or deployed position (see FIGS. 3 and 4). The spring 41 is also used to support the visual member 40 in its deployed position, i.e. by positioning the visual member 40 outward with respect to the back card panel 11. The visual member 40 has a surface 42 which is visible to a recipient/user of the greeting card when the visual member 40 is in its deployed position. Preferably, the surface 42 has a greeting message in the nature of, for example, a graphic design 43, such as a picture 44 and/or message 45.

The visual member can be constructed of any suitable material and does not have to be limited to the material used for constructed the back panel. As non-limiting examples, the visual member can be constructed of a feather, squash able foam ball or other toy, coil-type toy snake, etc.

The greeting card 10 further includes an audio source 50 which is supported by the back card panel 11 and which is used to play an audio signal. Preferably, the audio source 50 is supported by or embedded in the pocket formed in the back card panel 11 (i.e., it is disposed between the upper layer 23 and the lower layer 24) so that it is not visible to the recipient/user. In one embodiment, the audio source 50 includes an IC having memory 51 for storing one or more audio signals, a microprocessor 52, a battery 53, and a speaker 54. The audio signal can be a sound, dialog, melody, etc. When activated, the audio source 50 plays the audio signal to generate the melody, sound, etc. For example, playback of the audio signal may generate the melody for the "Happy Birthday" song or for some other songs which can be sequentially selected or randomly selected by the microprocessor 52 each time the card 10 is activated.

The audio signal can also be dialog which is played during a break in the melody or after the melody is completed to, for example, play the word "surprise" after the "Happy Birthday" song is completed. This type of sound-producing IC is well known in the art, and therefore will not be discussed in detail here.

The greeting card 10 further includes a user-manipulatable member 70 which controls a mechanical actuator 60. As shown in FIG. 5, the actuator 60 includes an input gear 61, a first intermediate gear 62 which meshes with the input gear 61, a second intermediate gear 63, and an output gear 64 which meshes with the second intermediate gear 63. The first and second intermediate gears 62, 63 are preferably integrally formed and are mounted on a common axle 65. In one embodiment, the first and second intermediate gears 62, 63 are sized so that every one revolution of the input gear 61 will generate about 1/10 to 1/12 revolution of the output gear 64 while the diameter of the output gear 64 remains relatively small compared with the width of the back card panel 11.

The user-manipulatable member 70 is configured as a flat crank member or handle which is connected to a first cam member 71. The crank handle 70 has a proximal end **70*b*, and a ring-shaped distal end 70*a* for receiving the tip of a user's finger to facilitate user rotation of the crank in its intended manner. The input gear 61, the proximal end 70*b* of the crank handle 70 and the first cam member 71 are all fixedly mounted on a common axle 72 so that they rotate together (See FIG. 6). As shown in the embodiment of FIG. 5, the first cam member 71 is of a substantially square shape, the four corners of which form four circumferential bumps 71*a*. A first switch such as a leaf switch 73 is disposed adjacent to the first cam member 71 and electrically connected to the audio source 50. When a circumferential bump 71*a* engages and disengages the leaf switch 73 as the crank handle 70 is rotated by a user, the leaf switch 73** opens and closes to generate a control signal which is used, as explained below, by the microprocessor to control the playback speed of the audio signal.

The actuator 60 further includes a second cam member 74 and a third cam member 75. The output gear 64, the second cam member 74, and the third cam member 75 are all fixedly mounted on a common axle 80 so that they rotate together (See FIG. 6). In a preferred embodiment, the output gear 64 and second and third cam members 74, 75 are integrally formed. As best illustrated in FIG. 5, each of the second and third cam members 74, 75 are configured as a cam disk having a circumferential bump 74*a*, 75*a*. Disposed adjacent to the third cam member 75 and electrically connected to the audio source 50 is a second switch, such as a leaf switch 81. When the circumferential bump 75*a* engages and disengages the leaf switch 81, the leaf switch 81 opens and closes.

As illustrated in FIG. 6, with the exception of the crank handle 70, the actuator 60 is preferably embedded in the back card panel 11 (i.e., it is disposed in a pocket between the upper layer 23 and the lower layer 24) so that it is not visible to the recipient/user. Preferably, the components of the actuator 60 are formed of molded plastic and are contained between upper and lower plates 76, 78 of a chassis 79. The plates 76, 78 are also preferably formed of plastic and the chassis 79 may also include the audio device 50. The axles 65, 72 and 80 are rotatably supported by the upper and lower plates 76, 78 of the chassis 79 in a known manner so that the input gear 61, the first and second intermediate gears 62, 63 and the output gear 64 are all rotatably supported by the chassis. The first and second switches 73, 81 are also preferably contained in the chassis 79.

Disposed between the door 31 and the second cam member 74 is a trigger 90. The trigger 90 is preferably supported by or embedded in the back card panel 11 (i.e., it is disposed between the upper layer 23 and the lower layer 24) and may be included in the chassis. The trigger 90 has a first end 92 which is disposed adjacent to the second cam member 74, a second end 93 which is disposed adjacent to the latch 33 of the door 31 and is biased by an urging member such as a spring 94 toward the latch 33, and a middle portion 95 which is rotatably supported to the back card panel 11 at a pivot point 91 by one or both of the upper and lower chassis plates 76, 77. Therefore, the trigger 90 is movable or rotatable between an engagement first position where its second end 93 engages the latch 33 of the door 31 to maintain the door 31 in the closed position and a disengagement second position where its second end 93 pushes against the biasing of the spring 94 to disengage the latch 33 and allow the door 31 to open. The engagement position is the default position. When the circumferential bump 74*a* of the second cam member 74 engages the first end 92 of the trigger 90, it pushes the trigger 90 to rotate from the default, engagement position toward the disengagement position, overcoming the urging or loading force of the spring 94, whereupon the door 31 opens. When the circumferential bump 74*a* disengages the first end 92 of the trigger 90 as the second cam member 74 continues to rotate due to continued user rotation of the handle 70, the spring 94 pushes the trigger 90 to rotate back to its default, engagement position.

In one embodiment, when the recipient/user opens the greeting card 10, the audio source 50 will not play the sound. When the recipient/user turns the crank handle 70 in the direction P (clockwise in FIG. 5), both the input gear 61 and the first cam member 71 will rotate. When the leaf switch 73 is first activated (i.e. closed or opened) by a circumferential bump 71*a*, the audio source 50 begins to play the selected sound or melody. The leaf switch 73 will be alternately closed and opened through interaction with the other circumferential bumps 71*a*. This opening and closing of the leaf switch 73 generates a control or "timing" signal which is used by the microprocessor to control the speed of playback of the audio signal. In other words, the cranking speed of the handle 70 directly affects the timing signal and, thereby, the speed of playback of the audio signal by the microprocessor. This feature enhances the appeal of the greeting card 10 because it allows the recipient to control the speed of playback of the audio signal.

It should be appreciated that the turning ratio of the crank handle to the closing and opening of the switch 73 can be modified by increasing or decreasing the size of the first cam member 71 or the number of bumps 71*a* on the first cam member 71. Thus, a first cam member configured with three sides will require more turning to open and close switch 73 as compared to a six-sided member, etc.

As the crank handle 70 is turned by a user, the second cam member 74 also rotates, although at a slower speed due to the gear ratios between gears 63 and 64. When the circumferential bump 74*a* comes into contact with the first end 92 of the trigger 90, the door 31 is released and moves to its opened position, whereupon any graphics such as a design and/or message contained in section 30 and/or on the inside of the door 31 will be revealed to the user. In this manner, the user controls the timing for the door 31 to be released by the speed in which the crank handle 70 is rotated. The user, however, will not know the precise moment when the door will be released, thereby producing an anticipation and entertaining effect on the part of the user.

In a preferred embodiment, the second switch 81 is also provided for causing playback of a second audio signal. In this embodiment, while the second cam 74 is rotating, the third cam 75 also rotates at the same speed such that, in addition to that the circumferential bump 74*a* engaging the trigger 90, the circumferential bump 75*a* engages the leaf switch 81. When the leaf switch 81 is engaged, a signal will cause the microprocessor 52 to play a second audio signal such that the playback of the second audio signal will be synchronized to occur relative to the opening of the door 31, i.e. immediately following the opening of the door, simultaneously with the opening of the door, etc. The playback of the second audio signal can occur at a predefined speed as dictated by the microprocessor without user control, or can be controlled by the timing signal generated from the user's continued movement of the handle 70. If user input is not required, then the second audio signal will simply be played upon activation of the switch 81. If, however, user input is required, continued rotation of the handle 70 by the user will be required in order to continue to generate the timing signal for the microprocessor to play the second audio signal.

In an embodiment where a deployable visual member 40 is contained behind the door 31, the opening of the door will also cause deployment of the visual member, thereby further enhancing the entertainment value of the greeting card 10. After the circumferential bump 75*a* disengages from the leaf switch 81, the audio device 50 is reset to its initial conditions, ready to play an audio signal stored in memory.

From the foregoing, it should be appreciated that the greeting card 10 presents a user with an entertainment value similar to the use of a well-known jack-in-the-box toy whose operation can be described as having a "setup" stage, followed by an "anticipation" stage and concluding with a "payoff" stage. The "setup" occurs as the user rotates the crank handle 70 whereupon an audio signal will be played. The audio signal will typically be followed by a short period of delay during which the user, as the handle 70 continues to be turned, is anticipating the release of the door 31. The "payoff" occurs when the door is released to reveal a "hidden" message and/or to deploy the visual member. Of course, if the audio signal feature is not included, then the "setup" and "anticipation" can be considered as being combined inasmuch as once the user turns the handle 70 the user is already anticipating the opening of the door 31.

The audio signal can embody any type of content, such as a sound effect, melody or dialog, such as a joke. In the latter case, the telling of a joke may commence when the handle is manipulated (e.g., rotated, etc.). This is then followed by a pause in the dialog whereupon the door 30 will open simultaneously with an optional sound effect and then the remainder or "punch-line" of the joke. The sound effect and/or "punch-line" will be contained in a second audio signal which is triggered by the activation of the second switch 81.

As an example in the case of a birthday card, the turning of the crank handle 70 will begin to play a first sound or melody such as the "Happy Birthday" song. At the end of the song, either immediately or after a slight delay to enhance the anticipation effect on the user, second cam member 74 will activate the trigger to release the door. This action can coincide with or be followed or preceded by the activation of the switch 81 which will cause a second audio signal to be played, such as the playing of the word "surprise". Of course, when the door is released, the visual member 40 will also be deployed.

It should be readily appreciated that the inclusion of the second audio signal and its activation by the manipulation of the switch 81 is simply a design choice used to further enhance the entertainment value of the greeting card 10. As an alternative, even if the switch 81 is not used to activate a second audio signal, the circumferential bump 74*a* will still activate the trigger 90 at a precise time, preferably simultaneously with, or with a slight delay after, the conclusion of the first audio signal.

In still another embodiment, the speed adjusting feature controlled by user manipulation of the crank handle 70 to open and close switch 73, thereby providing a timing signal to the microprocessor, can also be omitted. In such an embodiment, the first cam member 71 is omitted and the turning of the handle will, nevertheless, commence the rotation of the cam members 74 and 75 to release the trigger at the precise time, i.e. when the cam bump 74*a* engages the trigger 90. The third cam member 75 and its cam bump 75*a* can be configured to engage the second switch 81 to cause the microprocessor to commence playback of the audio signal, such as at the time the crank handle 70 is first manipulated, whereupon the microprocessor can then play the audio signal without further input by the user. In any event, i.e. with the speed control function provided by the switch 73, or without the speed control function, the second switch will be used to cause the microprocessor to "reset" for subsequent use of the greeting card, i.e. to cause playback of the first audio signal from the beginning of the first audio signal. This can be accomplished by the microprocessor sensing a change of state of the second switch 81 such as when the switch opens or closes. For example, the change of state of the second switch 81 (e.g., from open to closed or from closed to open) can signal or instruct the microprocessor to play the (first or second) audio signal and when the second switch moves back to the open position—which is after a delay based on the size of the third cam member 75—the microprocessor will be reset to be ready to play the first audio signal from the beginning. Alternatively, the change of state of the second switch 81 can signal or instruct the microprocessor to play the (first or second) audio signal followed by a pre-programmed delay, whereupon the microprocessor will be automatically reset, irrespective of the position of the second switch 81, to play the beginning of the audio signal for subsequent use.

It should also be readily appreciated that, in its most basic form, an audio signal and the mechanism to play it need not even be included in the greeting card 10. In such instance, both switches 73 and 81 can be omitted, along with the audio device 50 and the third cam member 75. In this instance, the turning of the handle 70 by the user at whatever speed the user chooses, will result in a proportional rotation of the second cam member 74 to release the door 31 and produce an anticipated visual effect to the user.

The greeting card 10 is reusable when the deployable visual member 40 is returned to its undeployed position and the cover 21 is swung back to its closed position with the catch 34 re-engaging the second end 93 of the trigger 90. This occurs via manual manipulation of the visual member by the user to re-compress the spring 41 and to then close the cover 21.

Figure 7:
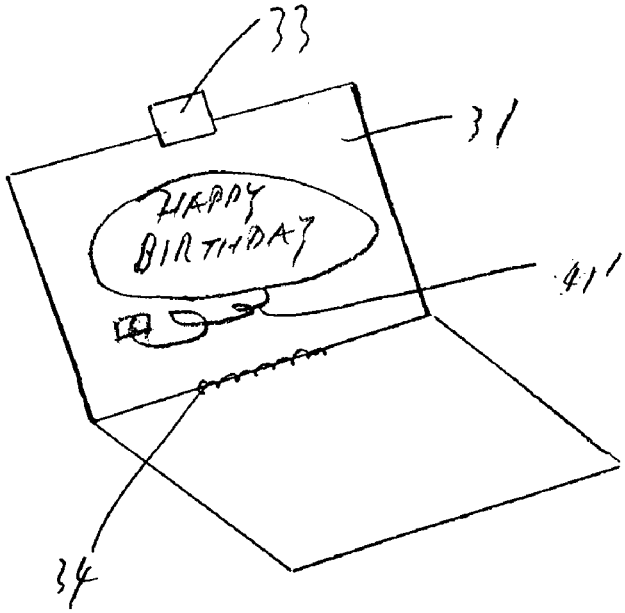
FIG. 7 shows another embodiment of the greeting card.

Various modifications can be made to the greeting card 10. For example, the tension spring 34 may be omitted. In that case, the coil spring 41 may be used to move the door 31 to its open position as well. The catch 33 may be omitted. In that case, the second end 93 of the trigger 90 directly engages the door 31. The cover panel 12 may be omitted as well. In addition, as illustrated in FIG. 7, instead of using the coil spring 41, a spring 41', which is disposed between the door 31 and the deployable visual member 40 with the two ends thereof being connected to or supported by the door 31 and the visual member 40, respectively, can be used to pop-up and support the deployable visual member 40. In that case, however, the tension spring 34 may be needed. The second and third cam members 74, 75 can be combined to form one unitary cam member with the bumps 74*a* and 75*a* angularly offset from, or aligned with, each other depending on the desired timing between activating the trigger 90 and activating the switch 81. The cranking power of the recipient/user can be used to power other interactive elements such as dancing flowers/animals or blowing fans. Lights such as LEDs can be added to the back card panel 11, the cover panel 12, the door 31, and/or the pop-up element 40, and the microprocessor 52 of the audio source 50 can be programmed to turn on the lights to create a special light effect at a pre-determined moment.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A greeting card comprising:

a first card panel;

a door connected to the first card panel and movable between a closed position where the door substantially covers a section of the first card panel and an open position where the door uncovers the section of the first card panel;

a trigger movable between a first position wherein the door is prevented from moving, and a second position wherein the door is allowed to move between the open position and the closed position; and a user-manipulatable member configured to rotate about an axis which, in response to user manipulation of the user-manipulatable member about the axis a plurality of times causes, the trigger to move from the first position to the second position to allow the door to move to the open position.

2. The greeting card of claim 1, further comprising an audio source operable to play an audio signal, and wherein the user-manipulatable member controls the playback of the audio signal.

3. The greeting card of claim 2, wherein the user-manipulatable member controls playback speed of the audio signal.

4. The greeting card of claim 2, wherein the trigger is configured to allow the door to move at the conclusion of the playback of the audio signal.

5. The greeting card of claim 4, wherein the trigger allows the door to move after a time interval following the playback of the audio sigal.

6. The greeting card of claim 1, further comprising a deployable visual member disposed between the section of the first card panel and the door;

an urging member connected to the deployable visual member to allow the deployable visual member to move between an undeployed position and a deployed position, the deployable visual member being in the deployed position when the door is in the open position.

7. The greeting card of claim 3, further comprising a deployable visual member disposed between the section of the first card panel and the door; and an urging member connected to the deployable visual member to allow the deployable visual member to move between an undeployed position and a deployed position, the deployable visual member being in the deployed position when the door is in the open position.

8. The greeting card of claim 7, wherein the movement of the deployable visual member to the deployed position moves the door to the open position.

9. The greeting card of claim 8, wherein the trigger is configured to allow the door to move at the conclusion of the playback of the audio signal.

10. The greeting card of claim 9, wherein the trigger allows the door to move after a time interval following the playback of the audio signal

11. The greeting card of claim 2, wherein the trigger allows the door to move during playback of the audio signal.

12. The greeting card of claim 9, wherein the trigger allows the door to move during playback of the audio signal.

13. The greeting card of claim 9, wherein the urging member connected to the deployable visual member is a coil spring disposed between the section of the first card panel and the deployable visual member.

14. The greeting card of claim 13, wherein the coil spring has two ends which are connected to the section of the first card panel and the deployable visual member, respectively.

15. The greeting card of claim 14, wherein the audio source is also operable to cause playback of a second audio signal.

16. The greeting card of claim 15, wherein playback of the second audio signal is independent of movement of the user-manipulatable member.

17. The greeting card of claim 15, wherein the user-manipulatable member controls the speed of playback of the second audio signal.

18. The greeting card of claim 14, further comprising:

an input gear rotatably supported by the first card panel and movable upon user manipulation of the user-manipulatable member;

a first cam member fixedly supported by the input gear;

a switch supported by the first card panel and disposed adjacent to the first cam member, the switch being connected to the audio source;

an output gear rotatably supported by the first card panel and in driving relationship with the input gear; and a second cam member fixedly supported by the output gear;

wherein rotating the user-manipulatable member causes the first cam member to engage the switch and generate a timing signal for use by the audio source in controlling playback speed of the audio signal, and wherein rotating the output gear causes the second cam member to engage the trigger.

19. The greeting card of claim 18, wherein said switch comprises a first switch, said greeting card further comprising a second switch engageable by the output cam for causing a second audio signal to be played.

20. The greeting card of claim 1, further comprising an audio source the audio source further comprising a microprocessor, a memory, and a speaker.

21. A greeting card comprising:

a first card panel;

a door connected to the first card panel and movable between a closed position where the door substantially covers a section of the first card panel and an open position where the door uncovers the section of the first card panel;

a trigger movable between a first position wherein the door is prevented from moving, and a second position wherein the door is allowed to move between the open position and the closed position; and a user-manipulatable member configured to move in a cycle which, in response to user manipulation of the user-manipulatable member for more than one of the cycle, moves the trigger from the first position to the second position to allow the door to move to the open position without direct user manipulation of the door.

22. The greeting card of claim 21, further comprising an audio source operable to play an audio signal, and wherein the user-manipulatable member controls the playback of the audio signal.

23. The greeting card of claim 22, wherein the user-manipulatable member controls playback speed of the audio signal.

24. The greeting card of claim 22, wherein the trigger is configured to allow the door to move at the conclusion of the playback of the audio signal

25. The greeting card of claim 21, further comprising a deployable visual member disposed between the section of the first card panel and the door;

an urging member connected to the deployable visual member to allow the deployable visual member to move between an undeployed position and a deployed position, the deployable visual member being in the deployed position when the door is in the open position.

26. The greeting card of claim 22, wherein the audio source is also operable to cause playback of a second audio signal.

* * * * *